US010520187B2

(12) United States Patent
Orawannukul et al.

(10) Patent No.: US 10,520,187 B2
(45) Date of Patent: Dec. 31, 2019

(54) BURNER WITH BAFFLE

(71) Applicants: Poravee Orawannukul, Tonawanda, NY (US); Reh-Lin Chen, Williamsville, NY (US); Bradley D Damstedt, Williamsville, NY (US)

(72) Inventors: Poravee Orawannukul, Tonawanda, NY (US); Reh-Lin Chen, Williamsville, NY (US); Bradley D Damstedt, Williamsville, NY (US)

(73) Assignee: Praxair Technology, Inc., Danbury, CT (US)

( * ) Notice: Subject to any disclaimer, the term of this patent is extended or adjusted under 35 U.S.C. 154(b) by 69 days.

(21) Appl. No.: 16/015,348

(22) Filed: Jun. 22, 2018

(65) Prior Publication Data

US 2019/0011125 A1 Jan. 10, 2019

Related U.S. Application Data

(60) Provisional application No. 62/529,025, filed on Jul. 6, 2017.

(51) Int. Cl.

| | |
|---|---|
| ***F23D 14/02*** | (2006.01) |
| ***F23D 14/46*** | (2006.01) |
| ***F23D 14/70*** | (2006.01) |
| ***F23M 20/00*** | (2014.01) |

(52) U.S. Cl.

CPC ..... *F23D 14/70* (2013.01); *F23D 14/02* (2013.01); *F23D 14/46* (2013.01); *F23M 20/005* (2015.01); *F23D 2210/101* (2013.01)

(58) Field of Classification Search

CPC ..... F23D 14/02; F23D 14/06; F23D 14/70

USPC ..... 431/114

See application file for complete search history.

(56) References Cited

U.S. PATENT DOCUMENTS

| | | | | |
|---|---|---|---|---|
| 2,805,685 | A | 9/1957 | Jopson | |
| 3,748,085 | A * | 7/1973 | Poepsel | F23M 20/005 431/114 |
| 3,810,732 | A * | 5/1974 | Koch | F23C 99/006 431/7 |
| 3,819,319 | A | 6/1974 | Schreter | |
| 3,907,489 | A | 9/1975 | Santisi | |
| 4,375,949 | A * | 3/1983 | Salooja | F23C 6/045 431/170 |
| 4,475,621 | A | 10/1984 | Cherington et al. | |
| 4,643,667 | A * | 2/1987 | Fleming | F23D 14/16 431/328 |

(Continued)

FOREIGN PATENT DOCUMENTS

| | | | |
|---|---|---|---|
| CA | 2132997 | A1 | 12/1995 |
| WO | 8505404 | A1 | 12/1985 |

OTHER PUBLICATIONS

Rayleigh, J.L., The Explanation of Certain Acoustical Phenomena, Nature, Jul. 18, 1878, 319-321, Nature Publishing Group.

*Primary Examiner* — Edelmira Bosques
*Assistant Examiner* — Nikhil P Mashruwala
(74) *Attorney, Agent, or Firm* — Donald T. Black

(57) ABSTRACT

In a burner in which fuel and gaseous oxidant are fed into the burner and combusted to produce a flame that extends out of an end of the burner, the noise produced by the burner is lessened by incorporating into the burner a baffle composed of a metal plate having a certain distribution of holes through the plate and a layer of metal filaments, and optionally a second metal plate.

17 Claims, 2 Drawing Sheets

(56) References Cited

U.S. PATENT DOCUMENTS

| | | | | | |
|---|---|---|---|---|---|
| 5,036,948 | A | | 8/1991 | Henn | |
| 5,166,479 | A | * | 11/1992 | Gras | F01D 25/02 181/256 |
| 5,344,308 | A | | 9/1994 | Cummings, III | |
| 5,525,056 | A | * | 6/1996 | Sutton | F23D 14/30 431/328 |
| 5,575,639 | A | * | 11/1996 | Pearl, II | F23D 14/50 15/373 |
| 5,580,238 | A | | 12/1996 | Charles, Sr. et al. | |
| 5,791,298 | A | | 8/1998 | Rodgers | |
| 5,879,031 | A | | 3/1999 | Bryant et al. | |
| 6,106,276 | A | | 8/2000 | Sams et al. | |
| 6,161,646 | A | * | 12/2000 | Curl | F01D 25/30 181/238 |
| 6,343,672 | B1 | * | 2/2002 | Petela | F01N 1/081 181/210 |
| 6,370,879 | B1 | | 4/2002 | Stalder et al. | |
| 6,923,002 | B2 | | 8/2005 | Crawley et al. | |
| 7,549,506 | B2 | | 6/2009 | Sattinger | |
| 2002/0100281 | A1 | | 8/2002 | Hellat et al. | |
| 2004/0101797 | A1 | * | 5/2004 | Mosiewicz | F23C 6/045 431/10 |
| 2009/0145688 | A1 | | 6/2009 | Marcoux | |
| 2010/0122869 | A1 | * | 5/2010 | Sengissen | B64C 23/005 181/264 |
| 2010/0284789 | A1 | * | 11/2010 | Brooks | F01D 5/26 415/119 |
| 2010/0313568 | A1 | | 12/2010 | Davis, Jr. et al. | |
| 2011/0165527 | A1 | | 7/2011 | Kim et al. | |

* cited by examiner

BURNER WITH BAFFLE

RELATED APPLICATIONS

This application claims the benefit of U.S. Provisional Application Ser. No. 62/529,025, filed on Jul. 6, 2017, which is incorporated herein by reference.

FIELD OF THE INVENTION

The present invention relates to burners and more specifically to burners that are employed in industrial applications such as glassmelting furnaces, incinerators, cement kilns, and power plants. In such burners fuel is combusted with gaseous oxidant to produce heat that is employed in the industrial application to heat, melt or combust material.

BACKGROUND OF THE INVENTION

The operation of industrial burners, in which streams of fuel and gaseous oxidant are fed into a burner and combusted in the burner, can generate significant acoustic resonance which has several drawbacks. The "Rayleigh criterion" (Rayleigh, J. L., Nature 18 (1878) 319-321) is commonly used for assessing the stability of a combustor. It states that if pressure and heat release fluctuations are in phase, the instability is fed by the flame and acoustics coupling.

The acoustic resonance can be exhibited as levels of noise that are unpleasant and even unsafe to nearby operators. In addition, interactions between the acoustic resonance and the flame of the burner can damage the burner, for instance by causing the flame to be unstable which can lead to overheating at certain surfaces of the burner. These phenomena are especially pronounced in burners in which the flame is formed within an enclosed chamber of the burner and emerges from an open end of the burner.

The present invention is a discovery of a burner that enables reduction of the acoustic resonance that may be exhibited by the burner.

BRIEF SUMMARY OF THE INVENTION

One aspect of the present invention is a burner comprising (A) a chamber having longitudinally opposed first and second ends, and a flame opening through the first end;

(B) a baffle in the chamber, having an outer edge which is adjacent to the interior surface of the chamber, the baffle having a first surface that faces toward the first end of the chamber and having a second surface that faces toward the second end of the chamber, and wherein the baffle is located in the chamber so that the second baffle surface is 5 to 10 inches from the interior surface of the second end of the chamber;

(C) a conduit that extends from a conduit inlet outside the chamber into the chamber and terminates at a conduit outlet in the section of the chamber that is between the first baffle surface and the flame opening, wherein the conduit outlet opens toward the flame opening;

(D) a passage that extends from a passage inlet outside the chamber and terminates at a passage outlet in the section of the chamber that is between the first baffle surface and the flame opening;

wherein the baffle comprises (1) a metal plate having a first plate surface that faces the flame opening and a second plate surface that faces the second end of the chamber, and (2) a layer of metal filaments in contact with the second plate surface, wherein the metal plate is one-eighth to half an inch in thickness, and a plurality of holes one-eighth to half an inch in diameter pass through the metal plate between the first and second plate surfaces, in a sufficient number of holes so that the total area of the openings of all holes in each plate surface is 30% to 50% of the surface area of the metal plate, and wherein the layer of metal filaments is a quarter of an inch to 4 inches thick, preferably at least 1.5 inches thick, exhibits a density of up to 0.5 ounces per cubic inch, and is composed of filaments up to 0.005 inches thick.

In yet another aspect of the present invention, the baffle further comprises a second metal plate that is in contact with the layer of metal filaments so that said layer is sandwiched between the second metal plate and the metal plate, and wherein the second metal plate is one-eighth to half an inch in thickness, and a plurality of holes one-eighth to half an inch in diameter pass through the second metal plate between its surfaces, in a sufficient number of holes so that the total area of the openings of all holes in each surface of the second metal plate is 30% to 50% of the surface area of the second metal plate.

DETAILED DESCRIPTION OF THE INVENTION

The present invention is applicable with a large variety of burner configurations. It is especially useful with burners in which one end of the flame that is formed by combustion of the fuel and the oxidant is inside a chamber or enclosure of the burner, so that a portion of the flame that extends from that end is also inside the chamber or enclosure of the burner, with the balance of the flame extending out of an opening of the burner.

The Figures illustrate several embodiments of burners with which the present invention is particularly useful.

Figure 1:
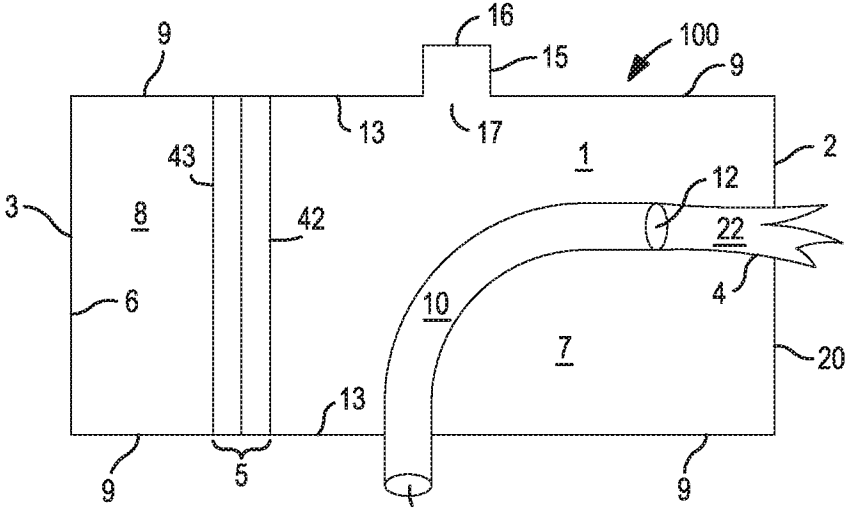
FIG. 1 is a cross-sectional view of an embodiment of a burner that incorporates the present invention.

Reference is made first to FIG. 1, which is a cross-sectional view of one such burner. Burner 100 is generally longitudinal in shape and comprises sidewall 9, first end 2, and second end 3, which together define chamber 1 inside the burner. Ends 2 and 3 are longitudinally opposed from each other. In a cross-section taken perpendicular to the longitudinal axis between ends 2 and 3, the chamber 1 can be circular or rectangular, which are preferred, or can be of another shape.

First end 2 is open, so that flame 22 having one end inside the chamber 1 can extend out through flame opening 4 to the space outside burner 100. Flame opening 4 can comprise the entire opening that is defined by the ends of sidewall 9. However, the present invention is particularly effective in embodiments in which first end 2 is partially closed by end plate 20, such that the area of flame opening 4 is smaller than the total area of first end 2 that is defined by the ends of sidewall 9. Second end 3 is closed, and may have one or more conduits passing through it as described herein provided that the joint between second end 3 and any such conduits is sealed against gas passing through the joint.

Figure 2:
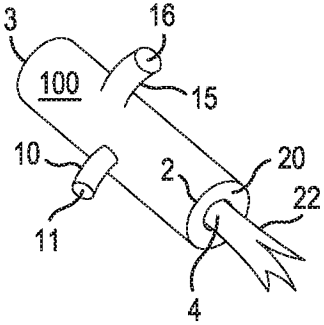
FIG. 2 is a perspective view of the exterior of the embodiment shown in FIG. 1.

FIG. 2 shows the external appearance of one such burner, in which the cross-section that is perpendicular to the axis that extends between ends 2 and 3 is circular.

Referring again to FIG. 1, conduit 10 passes from outside burner 100 into chamber 1, Conduit 10 ends in chamber 1 at conduit outlet 12, which opens toward flame opening 4, by which is meant that material which passes out of conduit outlet 12 is necessarily moving toward flame opening 4. Preferably, the central axis of conduit outlet 12 passes through flame opening 4. Conduit 10 includes conduit inlet 11 which is outside burner 100. Conduit inlet 11 can be connected to a source of fuel to be combusted in chamber 1. Suitable fuel includes any combustible gaseous material, such as natural gas, methane, or other combustible hydrocarbons and mixtures thereof. In operation of the burner, fuel that emerges from conduit outlet 12 combusts in flame 22 such that one end of flame 22 is at conduit outlet 12.

Passage 15 is also provided. It extends from passage inlet 16 that is outside burner 100 to passage outlet 17 that is inside chamber 1. Passage inlet 16 can be connected to a source of gaseous oxidant to be combusted in chamber 1 with the fuel that is fed through conduit 10. Suitable gaseous oxidant includes air, oxygen-enriched air, and commercial high purity oxygen. Thus, the oxygen content of the gaseous oxidant can be that of air (about 21 vol. %) up to 95 vol. % or higher, even 99 vol. % or higher.

The burners of the present invention also include baffle 5. As seen in FIG. 1, baffle 5 includes a first surface 42 that faces toward first end 2, and baffle 5 includes a second surface 43 that faces toward second end 3. Baffle 5 includes an outer edge 41 (seen in FIG. 3) which extends completely around baffle 5. Outer edge 41 is adjacent to the interior surface 13 of chamber 1, by which is meant that either all of outer edge 41 continuously contacts the interior surface 13, or a portion less than all of outer edge 41 contacts the interior surface 13. Where outer edge 41 is not in contact with interior surface 13, the gap between outer edge 41 and the closest point on surface 13 should be up to a quarter of an inch (0.25 inch). Baffle 5 separates the interior of chamber 1 into two sections, namely, combustion section 7 in which fuel emerging from conduit outlet 12 is combusted, and rear section 8. Thus, both conduit outlet 12 and passage outlet 17 are located in combustion section 7 of chamber 1.

As seen in FIG. 1, burner 100 can be configured so that the locations where conduit 10 and passage 15 pass through the sidewall 9 of burner 100 are in combustion section 7. However, if desired, conduit 11 and/or (less preferably) passage 15 can be located so that it passes through rear section 8, in which case the conduit or passage as the case may be passes through baffle 5 so that their respective outlets are in combustion section 7.

It has been found that when a baffle 5 as described herein, is included in the construction and operation of a burner as described herein, the operation of the burner is accompanied by much less noise and acoustic resonance than is observed upon combustion without the baffle. It has been found that the baffle 5 should be located in chamber 1 so that the distance from the interior surface 6 of second end 3 to the second surface 43 of baffle 5 should be 5 to 10 inches, preferably about 6 inches. Surprisingly it has been found that this characteristic distance is independent of the other dimensions of the burner and of the operating conditions of the burner.

Figure 3:
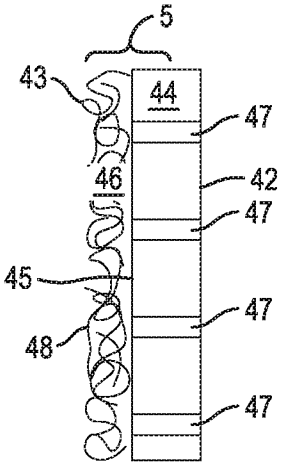
FIG. 3 is a side cross-sectional view of an embodiment of a baffle that is useful in the present invention.
Figure 5:
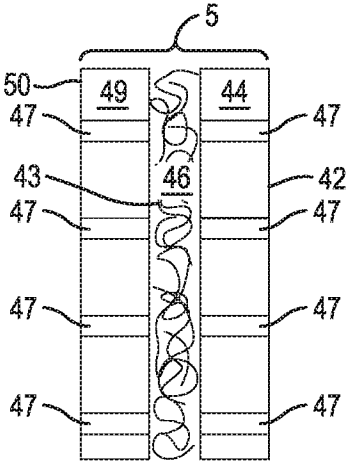
FIG. 5 is a side cross-sectional view of another embodiment of a baffle that is useful in the present invention.
Figure 4:
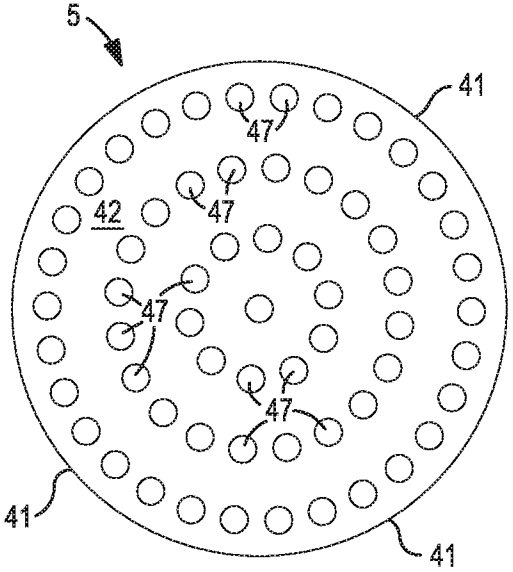
FIG. 4 is a front plan view of an embodiment of a baffle that is useful in the present invention.

The baffle is further described herein with reference to FIGS. 3, 4 and 5.

FIG. 3 shows a cross-sectional view of a baffle 5 in a preferred embodiment which comprises first surface 42 and second surface 43 as described above. In this embodiment of baffle 5 there are two components, namely metal plate 44 and layer 46 of metal filaments.

Metal plate 44 is made of any metal that retains its shape at the combustion temperatures which are produced in combustion section 7. Examples of suitable metals include brass and steel. Metal plate 44 is preferably one-eighth of an inch to half an inch in thickness, where the thickness is defined as the distance between surface 42 and rear surface 45 of metal plate 44. Metal plate 44 should extend throughout the diametrical width of baffle 5, that is, all the way to edge 41 all the way around baffle 5.

As seen in FIG. 3 and in FIG. 4, numerous holes 47 pass through metal plate 44 from surface 42 through to surface 45. Each hole is preferably one-eighth of an inch to half an inch in diameter. The holes can all be the same diameter, or they can vary in diameter. There should be enough holes 47 so that the sum of the areas of the openings of all of the holes in a surface 42 is 30% to 50%, preferably about 40%, of the total surface area of surface 42.

Baffle 5 also includes layer 46 of metal filaments. Layer 46 should be in contact with surface 45, although of course not all of the material of which layer 46 is formed needs to be in contact with surface 45. The metal filaments, shown as 48, are each up to 0.005 inch in diameter and are randomly intertwined with each other sufficiently to form a unitary mat of material. Such a mat is considered to be unitary if, when a single unitary quantity of the mat is held at one point so that it hangs from that one point of support and is not otherwise supported, it remains as one unitary quantity and does not break into additional pieces. The layer 46 is not a solid block but also contains spaces between the intertwined filaments. The density (uncompressed) of the layer should be up to 0.5 ounces per cubic inch. Suitable examples of material for layer 46 include products known as "metal wool", such as steel wool or brass wool.

Layer 46 when incorporated into baffle 5 should be at least a quarter of an inch (0.25 inch) thick along the axis that extends between ends 2 and 3 of chamber 1. This thickness should preferably be up to 6 inches thick. Thicker layers are acceptable provided that the distance between the rear surface 43 and the interior surface 6 remains as described herein. The benefit in reduced acoustic resonance, with each additional inch of thickness of the layer 46, may decrease.

FIG. 5 depicts an alternative embodiment of baffle 5, which includes metal plate 44 and layer 46 as described herein, and which also includes a second metal plate 49 which is in contact with surface 43 of layer 46. The characteristics of second metal plate 49 (material from which it is made, thickness, width, the presence of holes, the areas of the holes, and the total area of holes relative to the surface area of the surface of plate 49) are the same as the characteristics described herein for metal plate 44.

In operation of the burner, fuel is fed through conduit outlet 12 into combustion section 7 of chamber 1, and oxidant is passed out of passage outlet 17 into combustion section 7 of chamber 1, and they are ignited and combusted. The combustion forms a flame whose base is at outlet 12. The flame extends out of chamber 1 through flame opening 4. The fuel and oxidant should be fed at relative mass flow rates so that the oxygen in the oxidant constitutes 300 to 20,000% of the amount of oxygen needed to completely combust the fuel. The velocities of each flow prior to combustion are preferably an oxygen flow rate of 5 to 20 feet per second and a fuel flow rate of 30 to 50 feet per second.

What is claimed is:

1. A burner comprising (A) a chamber having longitudinally opposed first and second ends, and a flame opening through the first end;

(B) a baffle in the chamber, having an outer edge which is adjacent to the interior surface of the chamber, the baffle having a first surface that faces toward the first end of the chamber and having a second surface that faces toward the second end of the chamber, and wherein the baffle is located in the chamber so that the second baffle surface is 5 to 10 inches from the interior surface of the second end of the chamber;

(C) a conduit that extends from a conduit inlet outside the chamber into the chamber and terminates at a conduit outlet in the section of the chamber that is between the first baffle surface and the flame opening, wherein the conduit outlet opens toward the flame opening;

(D) a passage that extends from a passage inlet outside the chamber and terminates at a passage outlet in the section of the chamber that is between the first baffle surface and the flame opening;

wherein the baffle comprises (1) a metal plate having a first plate surface that faces the flame opening and a second plate surface that faces the second end of the chamber, and (2) a layer of metal filaments in contact with the second plate surface, wherein the metal plate is one-eighth to half an inch in thickness, and a plurality of holes one-eighth to half an inch in diameter pass through the metal plate between the first and second plate surfaces, in a sufficient number of holes so that the total area of the openings of all holes in each plate surface is 30% to 50% of the surface area of the metal plate, and wherein the layer of metal filaments is at least 0.25 inch thick, up to 6 inches thick, exhibits a density of up to 0.5 ounces per cubic inch, and is composed of filaments up to 0.005 inches thick.

2. A burner according to claim 1 wherein the metal plate is made of brass or steel.

3. A burner according to claim 1 wherein all of the outer edge of the baffle continuously contacts the interior surface of the chamber.

4. A burner according to claim 1 wherein less than all of the outer edge of the baffle contacts the interior surface of the chamber, and the gap between the outer edge of the baffle and the closest point on the interior surface of the chamber is up to a quarter of an inch.

5. A burner according to claim 1 wherein the metal plate extends throughout the diametrical width of the baffle.

6. A burner according to claim 1 wherein the metal filaments are made of steel wool or brass wool.

7. A burner according to claim 1 wherein the layer of metal filaments is up to 6 inches thick.

8. A burner comprising (A) a chamber having longitudinally opposed first and second ends, and a flame opening through the first end;

(B) a baffle in the chamber, having an outer edge which is adjacent to the interior surface of the chamber, the baffle having a first surface that faces toward the first end of the chamber a having a second surface that faces toward the second end of the chamber, wherein the baffle is located in the chamber so that the second baffle surface is 5 to 10 inches from the interior surface of the second end of the chamber;

(C) a conduit that extends from a conduit inlet outside the chamber into the chamber and terminates at a conduit outlet in the section of the chamber that is between the first baffle surface and the flame opening, wherein the conduit outlet opens toward the flame opening;

(D) a passage that extends from passage inlet outside the chamber and terminates at a passage outlet in the section of the chamber that is between the first baffle surface and the flame opening;

wherein the baffle comprises (1) a first a metal plate having a first plate surface that faces the flame opening and a second plate surface that faces the second end of the chamber, and (2) a layer of metal filaments in contact with the second plate surface, wherein the first metal plate is one-eighth to half an inch in thickness, and a plurality of holes one-eighth to half an inch in diameter pass through the first metal plate between the first and second plate surfaces, in a sufficient number of holes so that the total area of the openings of all holes in each surface of the first metal plate is 30% to 50% of the surface area of the first metal plate, and wherein the layer of metal filaments is at least 0.25 inch thick, up to 6 inches thick, exhibits a density of up 0.5 ounces per cubic inch, and is composed of filaments up to 0.005 inches thick, wherein the baffle further comprises a second metal plate that is in contact with the layer of metal filaments so that said layer is sandwiched between the second metal plate and the first metal plate, and wherein the second metal plate is one-eighth to half an inch in thickness, and a plurality of holes one-eighth to half an inch in diameter pass through the second metal plate between its surfaces, in a sufficient number of holes so that the total area of the openings of all holes in each surface of the second metal plate is 30% to 50% of the surface area of the second metal plate.

9. A burner according to claim 8 wherein the second metal plate is made of brass or steel.

10. A burner according to claim 8 wherein the second metal plate extends throughout the diametrical width of the baffle.

11. A burner according to claim 8 wherein the first metal plate is made of brass or steel.

12. A burner according to claim 8 wherein all of the outer edge of the baffle continuously contacts the interior surface of the chamber.

13. A burner according to claim 8 wherein less than all of the outer edge of the baffle contacts the interior surface of the chamber, and the gap between the outer edge of the baffle and the closest point on the interior surface of the chamber is up to a quarter of an inch.

14. A burner according to claim 8 wherein the first metal plate extends throughout the diametrical width of the baffle.

15. A burner according to claim 8 wherein the metal filaments are made of steel wool or brass wool.

16. A burner according to claim 8 wherein the first metal plate and the second metal plate are made of brass or steel.

17. A burner according to claim 8 wherein the first metal plate and the second metal plate extend throughout the diametrical width of the baffle.

* * * * *